United States Patent [19]

Reid et al.

[11] Patent Number: 4,613,043

[45] Date of Patent: Sep. 23, 1986

[54] BOTTLE CLOSURE

[76] Inventors: Philip L. Reid, Rte. 2, Box 422, Duncan, S.C. 29334; Edward L. Holcombe, 21 Rowley St., Greenville, S.C. 29601

[21] Appl. No.: 720,854

[22] Filed: Apr. 8, 1985

[51] Int. Cl.[4] ..... B65D 39/16

[52] U.S. Cl. ..... 206/428; 53/412; 53/489; 215/296

[58] Field of Search ..... 215/296; 206/428; 53/412, 489

[56] References Cited

U.S. PATENT DOCUMENTS

| | | | |
|---|---|---|---|
| 326,272 | 9/1885 | Canterbury | 215/296 |
| 785,722 | 3/1905 | Dunn | 215/296 |
| 810,476 | 1/1906 | Dunn | 215/296 X |
| 1,615,150 | 1/1927 | Vallens | 215/296 X |

*Primary Examiner*—Donald F. Norton

*Attorney, Agent, or Firm*—Bailey & Hardaway

[57] ABSTRACT

A novel and effective closure for a bottle opening which, when associated with a seal, provides an effective means for removing the cork and the breakage of the seal simultaneously.

3 Claims, 6 Drawing Figures

BOTTLE CLOSURE

BACKGROUND OF THE INVENTION

This invention relates generally to the art of closures and more particularly to a novel cork closure for a bottle opening.

Cork closures have been commonly utilized with glass containers for many purposes for most of recorded history. At a point in history almost all glass containers were closed utilized corks. This was particularly true for medicines and for wines. At the current time bottled wine is one of the last remaining items utilizing a cork closure.

Corks utilized as closures have conventionally been removed from the container utilizing a corkscrew. Corkscrews are difficult to utilize and frequently severely damage the cork rendering it unsuitable for future use. Various devices have been developed in order to circumvent the need for corkscrew utilization. Such devices were generally developed during the period in time when cork closures were utilized more broadly. One such device is described in U.S. Pat. No. 328,672 to Hayward. There is described therein the utilization of a slotted cork which carries a means for removing a cork within the slot. Another such device is described in U.S. Pat. No. 278,388 to Berlien. There is described therein a strap which extends beneath a cork for utilization in removing the cork from the bottle.

Various other devices are described in the following U.S. Pat. Nos. 507,669 to Atwood; 53,090 to Bousiques; 314,359 to Bernardin; 262,574 to Cooke 676,018 to Wilson; 810,331 to Gallagatr; and 2,004,690 to Fonyo.

While such devices as described above functioned very well in the time of their utilization, there have been no current processes or devices to ease the complications associated with mechanical means utilized for removal of corks from such wine bottles.

SUMMARY OF THE INVENTION

It is thus an object of this invention to provide a novel closure for a bottle opening.

It is a further object of this inventon to provide such a closure which permits the removal of cork and breakage of seal simultaneously.

These as well as other objects are accomplished by closure for a bottle opening which includes a cork and a ribbon loop supporting the cork and lodged within the opening with the cork. A seal encircles the neck of the bottle and traps the ribbon loop beneath it while exposing a portion of the loop. The exposed portion of the loop may be grasped and in one motion extended to break the seal and remove the cork from the opening.

DETAILED DESCRIPTION

In accordance with this invention it has been found that a novel and effective closure may be provided utilizing a ribbon loop in association with a cork to form a closure which, when associated with a seal, provides an effective means of removing the seal and the cork in one movement with an extension of the loop. Other advantages and features will become apparent from a reading of the following description given with reference to the various figures of drawing.

Figure 1:
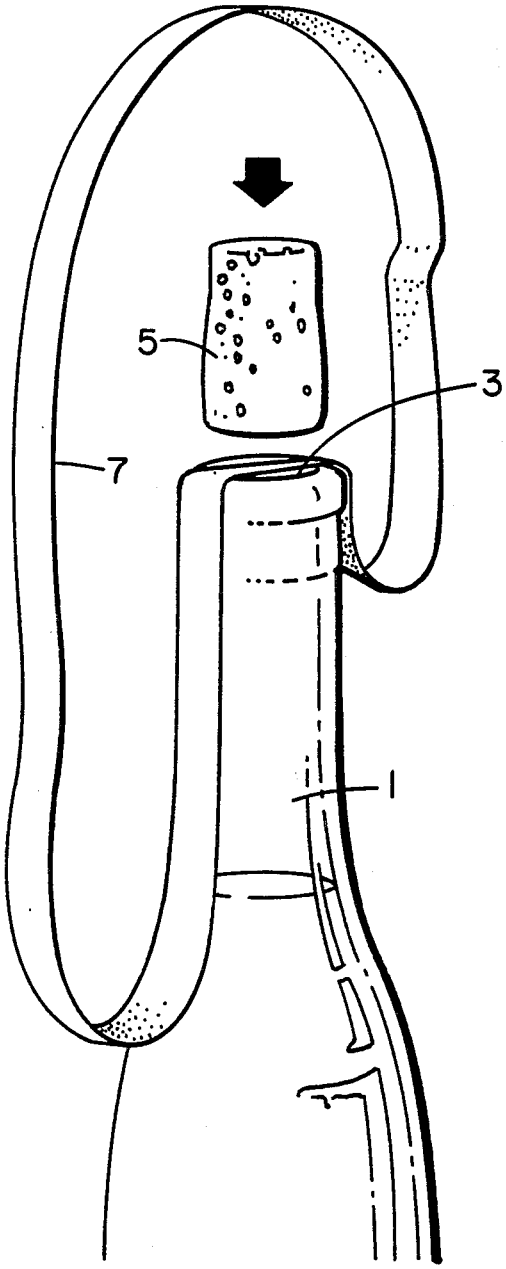
FIGS. 1 and 2 illustrate a bottle with a closure in accordance with this invention.
Figure 2:
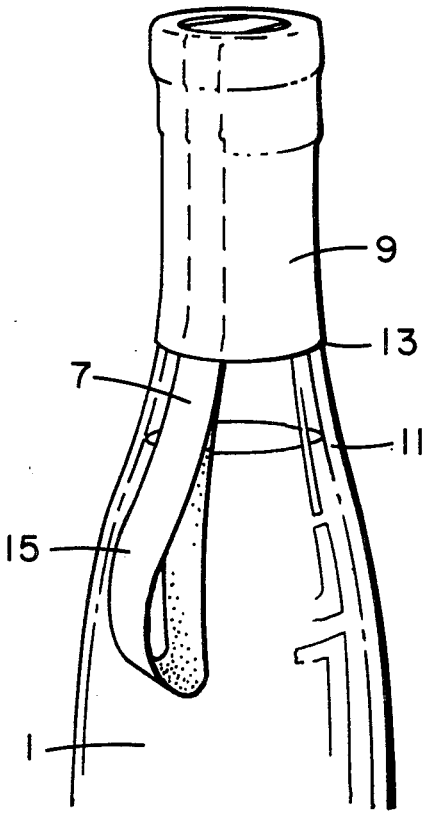

Referring to FIGS. 1 and 2 of the drawings there is illustrated a bottle 1 defining an opening 3 into which is received a cork 5 which moves about its longitudinal direction into the opening 3. Upon insertion of the cork 5 into the opening 3 a ribbon loop 7 inserted into the path of the cork 5 moves into the opening 3 along with cork 5. Upon placement into the opening 3 the loop is in a supportive position for cork 5.

FIG. 2 of the drawings illustrates the loop 7 draped to one side of bottle 1 after insertion into opening 3.

Additionally illustrated in FIG. 2 is a conventional seal 9 which may be former of lead or plastic material. Seal 9 extends about neck 11 of bottle 1 to a desired point 13. It is seen that loop 7 extends beyond point 13 to expose a grip 15. FIG. 2 of the drawings thus illustrates a container with a closure in accordance with this invention which may be utilized in the manner described below with regard to FIGS. 3 and 4.

Figure 3:
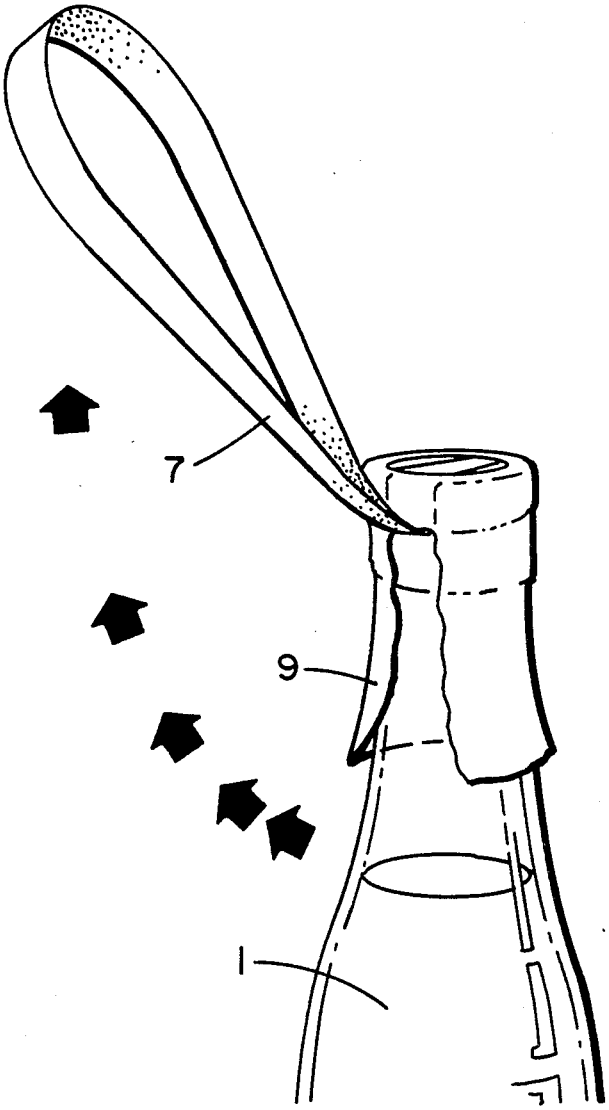
FIGS. 3 and 4 schematically illustrate the removal or use of the closure in accordance with this invention.
Figure 4:
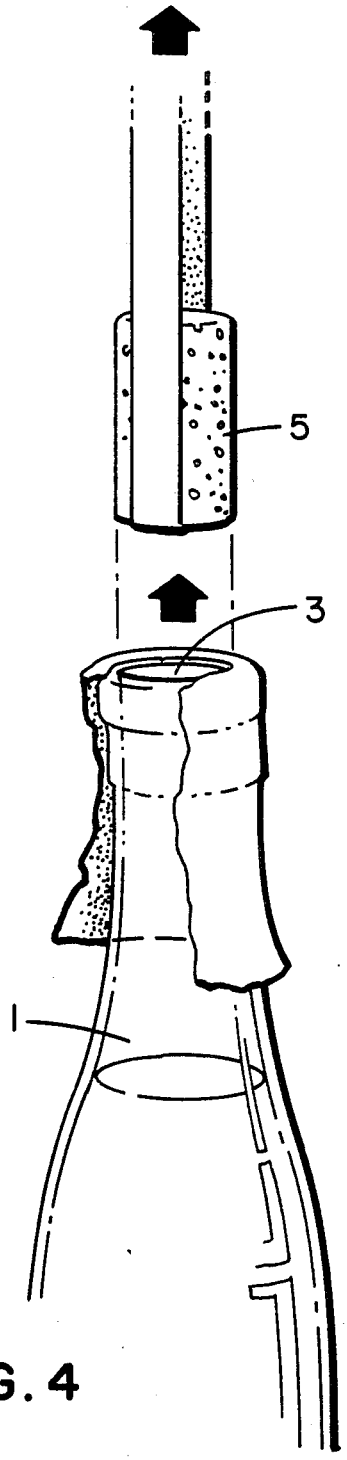

Referring to the gripping loop 15 in FIG. 2 it is seen that upon extension of loop 7 in the longitudinal direction of cork 5 that seal 9 is broken as illustrated in without FIG. 3 and that continuation of the same motion as illustrated in FIG. 4 results in removal of cork 5 from opening 3. Thus, one motion both breaks the seal and removes the cork from the bottle opening 3. It is seen that the arrangement illustrated in FIGS. 1, 2, 3 and 4 provides a corked bottle which may be opened without the utilization of auxiliary means such as a corkscrew and the like. It is additionally seen that the cork is removed without damage to same and that it may be readily reused either with or without the loop 7 of this invention.

Figure 5:
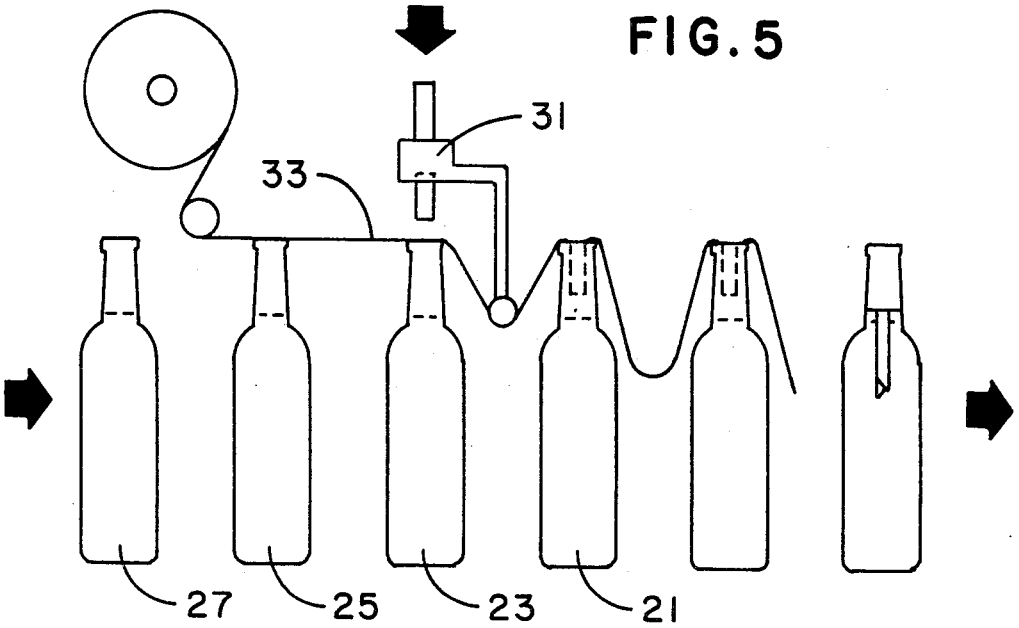
FIG. 5 illustrates a process of mass producing the closure in accordance with this invention.

FIG. 5 of the drawings illustrates the adaptability of the closure of this invention to conventional corking techniques. Additionally, FIG. 5 illustrates a process in accordance with this invention wherein a plurality of bottles 21, 23, 25 and 27 move in seriatum fashion beneath a cork inserting apparatus 31 and wherein a continuous ribbon 33 is fed beneath cork inserting means 31 to provide a series of bottles having corks therein and with ribbon 33 running from beneath the cork in one bottle to the next adjacent bottle.

It is apparent that the series of bottles illustrated in FIG. 5 may be severed from the other and adhesively secured about the severed ends to form the loop 7 illustrated in FIG. 3 or to form the embodiment described with reference to FIG. 6.

It is additionally apparent that the series of bottles connected together as in FIG. 5 may be grouped and marketed in bunches such as conventinal six-packs with one bottle connected to the next so that ribbon 7 provides not only a means for cork removal, but a connecting device for a plurality of containers.

Figure 6:
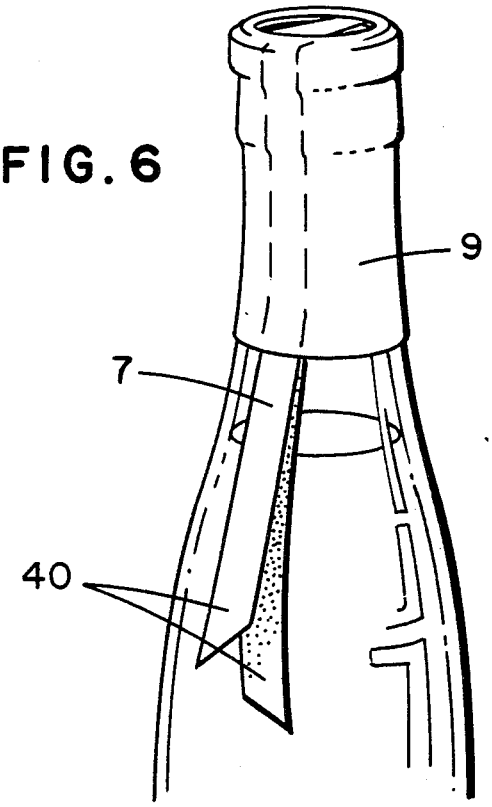
FIG. 6 illustrates another embodiment of this invention.

FIG. 6 of the drawings illustrates yet another embodiment of the invention wherein loop 7 is not continuous but has severed ends 40 for grasping and removal in the manner illustrated in FIGS. 3 and 4.

It is thus seen that a novel bottle closure is provided by this invention. It is further seen that this invention provides not only a novel closure but a process of producing such a closure. Such closure may be utilized to remove a cork from a bottle without need for additional auxiliary equipment and which also permits simultaneous removal of a seal and the cork. As many variations will become apparent to those of skill in the art from the reading of the above description which is exemplary in nature, such variatons are embodied with the spirit and scope of this invention as defined by the following appended claims.

That which is claimed is:

1. A process for closing bottles, comprising the steps of:

inserting a cork in a longitudinal direction into the opening of a bottle, said cork conforming to the dimensions of said opening;

inserting a ribbon into the path of travel of said cork wereby said ribbon moves in the longitudinal direction with said cork and into said opening;

continuing said steps of inserting a cork and inserting a ribbon into a series of bottles in seriatim fashion, said ribbon being fed successively to each progressive cork whereby a plurality of corked bottles are produced, each connected by said ribbon.

2. The process according to claim 1 comprising the further step of severing said ribbon between adjacent bottles to form ribbon ends associated with each bottle;

forming seals about each successive bottle with a portion of said ribbon ends extending from said seal whereby said ends may be gripped and in one motion extended to break said seal and remove said cork from said opening.

3. A plurality of corked bottles each connected to another of said bottles by a ribbon extending from beneath each cork within each bottle to another of said corks within another of said bottles.

* * * * *